United States Patent [19]

Nelson

[11] Patent Number: 4,613,175

[45] Date of Patent: Sep. 23, 1986

[54] LOCKING DEVICE FOR CLOSURES

[76] Inventor: Bascom M. Nelson, P.O. Box 241, Beeville, Tex. 78102

[21] Appl. No.: 579,609

[22] Filed: Feb. 13, 1984

[51] Int. Cl.[4] ..... E05C 1/04

[52] U.S. Cl. ..... 292/148; 70/56

[58] Field of Search ..... 292/148, 205, 104, 302, 292/DIG. 30; 70/54, 56; 248/316.7

[56] References Cited

U.S. PATENT DOCUMENTS

| | | | |
|---|---|---|---|
| 1,219,488 | 3/1917 | Rompf | 292/148 X |
| 1,961,041 | 5/1934 | Gilbert, Jr. | 292/148 |
| 3,334,933 | 8/1967 | Ehlers | 292/148 |
| 3,606,423 | 9/1971 | McCarthy | 292/148 |
| 3,828,591 | 8/1974 | Beaver | 70/56 |
| 4,068,505 | 1/1978 | Volk, Jr. | 292/148 X |
| 4,307,904 | 12/1981 | Daus | 292/148 |

FOREIGN PATENT DOCUMENTS

| | | | |
|---|---|---|---|
| 103308 | 2/1964 | Norway | 70/56 |

*Primary Examiner*—Richard E. Moore

*Attorney, Agent, or Firm*—G. Turner Moller

[57] ABSTRACT

A locking device is used to lock a closure, such as a garage or metal door and includes a housing to receive a padlock. The housing is configured to obstruct access to the padlock shackle so that it cannot be cut with bolt cutters. The housing also includes a pair of aligned openings which allow a shackle of a second padlock to be passed through the housing to prevent unlocking movement of the first padlock. In one embodiment of the invention, the locking device includes a bolt mechanism on the inside of the housing which is generally hook-shaped and positioned to abut a locked padlock supported on the inside of the housing. When the padlock is unlocked, the padlock body moves out of the way of one end of the hook-shaped structure thereby allowing the bolt to be retracted to an unlocked position. In a second embodiment of the invention, the padlock body is suspended in the housing so that, in an unlocked position thereof, a tongue is capable of passing through the opening between the shackle and the padlock body. In a locked position of the padlock, the tongue is encapable of being withdrawn.

9 Claims, 6 Drawing Figures

LOCKING DEVICE FOR CLOSURES

This invention relates to a locking device for closures, such a garage doors, metal doors, windows or the like and more specifically to a locking device which incorporates a padlock for securing the device in a locked position.

One of the problems with padlock type locking devices is that they are manifestly subject to being cut by bolt cutters. Bolt cutters are widely available through commercial hardware stores and the like and consequently provide a deterrence to only the most amateur class of th.eves. In response thereto, proposals have been made in the prior art to provide housing mechanisms which enclose the shackle of padlocks in order to protect the shackle of padlocks from bolt cutters. More accurately, the housings obstruct access to the padlock shackle so that the bolt cutters cannot get to them. Disclosures of this type are found in exemplary U.S. Pat. Nos. 2,766,605; 3,392,555; 3,590,607 and 3,606,423.

The locking device of this invention is particularly suited for use in storage buildings, known as mini warehouses. Many warehouses typically include a metal door which is mounted on a suitable frame for closing movement. A bolt type latch is often used to latch the door in its closed position. In the looking device of this invention, the bolt is mounted for movement inside a housing which provides, at the other end thereof, a handle for manipulating the bolt. A padlock is captivated inside the housing and, in an unlocked position of the padlock, allows free and unobstructed movement of the bolt mechanism for latching and unlatching the door. When the padlock is moved to a locked position, it moves upwardly inside the housing to a position where it obstructs sliding movement of the bolt mechanism thereby preventing the bolt mechanism from moving to its unlatched position. Consequently, the locking device of this invention not only provides a mechanism for locking the door relative to its frame but also provides a housing which prevents a bolt cutter from reaching the padlock shackle.

Another feature of this invention which is particularly desirable for use in mini warehouses is that a provision is made for accepting a second padlock which will prevent unlocking movement of the bolt, regardless of whether the first padlock is in its locked or unlocked position. This is particularly desirable when the mini warehouse manager desires to lock out an unpaying tenant. The tenant's padlock will, of course, be in its protected position inside the housing. The mini warehouse owner may lock out the tenant by placing a second padlock in the housing to prevent the tenant from reaching his goods. This, of course, induces tenants to pay their rent.

Another embodiment of this invention is particularly adapted for use with pivotally mounted doors, as opposed to an overhead type of door. In this embodiment, a housing is provided to receive a padlock. A clip inside the housing grasps the shackle of the padlock and holds it in a normal vertical position in which the shackle of the padlock is located substantially wholly within the housing. Accordingly, access to the shackle is obstructed. When the door is closed, a striker or tongue carried by the stationary part of the door frame enters the housing. In an unlocked position of the padlock, the tongue is free to move to a closed position. Locking of the padlock obstructs retracting movement of the striker relative to the housing thereby locking the door in place.

In this embodiment of the invention, provision is also made for accepting a second padlock which will prevent unlocking movement of the padlock. Accordingly, the second embodiment of the invention also has particular attractiveness in a mini warehouse situation.

In summary, this invention comprises a locking device for securing a closure in a locked condition and a protective assembly for a first padlock having a body and a shackle movable into and out of locking engagement with the shackle. The device comprises a housing having an opening at one end thereof for receiving the first padlock, means in the enclosure for supporting the first padlock in a locked position and in an unlocked, and a locking mechanism engagable with the first padlock in the locked position thereof for securing the closure in the locked condition and movable relative to the first padlock in the unlocked position thereof for allowing the closure to move to an unlocked condition, the housing providing a pair of aligned openings therethrough for receiving a shackle of a second padlock, the shackle of the second padlock being positioned to block unlocking movement of the locking mechanism.

In summary, this invention comprises a protective assembly for a padlock of the type having a body and a shackle shiftable into and out of locking engagement with the body. The assembly comprises a padlocking closure having front, side and top walls providing an open bottom end defining a first path for receiving the padlock and an open back defining a second path intersecting the first path, means in the enclosure for supportably receiving the shackle of the padlock and supporting the padlock in a verticle position with the shackle elevated above the body, and a tongue configured to pass through the open back along the second path and through the shackle when the padlock is supported on the supporting means and the shackle is out of locking engagement with the body, the tongue having blocking structure engagable with the body when the shackle is closed about the tongue in locking engagement with the body for preventing withdrawal of the tongue.

In summary, this invention comprises a locking device incorporating a housing having a plurality of openings therein, a mechanism mounted for movement in the housing having a bolt extendable out of the housing through one of the openings, a handle extendable out of the housing through another of the openings for advancing and retracting the bolt and a structure for selectively blocking and unblocking movement of the bolt in response to a padlock body being appropriately located in the housing. The device further comprises a support in the housing and a padlock having a shackle supportedly received on the support and a body, at least partially in the housing, located in blocking relation with the structure in a locked position of the padlock and movable to an unblocking position allowing movement of the structure in response to unlocking of the padlock. The padlock body is accessible through one of the housing openings so that the padlock may be unlocked. The shackle is, of course, wholly located within the housing and is accordingly inaccessible to bolt cutters.

It is accordingly an object of this invention to provide a simple and inexpensive locking device which is capable of obstructing access to a padlock shackle and which incorporates a bolt for latching a closure to its frame.

Another object of this invention is to provide a locking device which is capable of protecting the shackle of a padlock and which provides means for locking the device with a second padlock.

Other objects and advantages of this invention will become more fully apparent as this description proceeds, reference being made to the accompanying drawing and appended claims.

IN THE DRAWING

Figure 3:
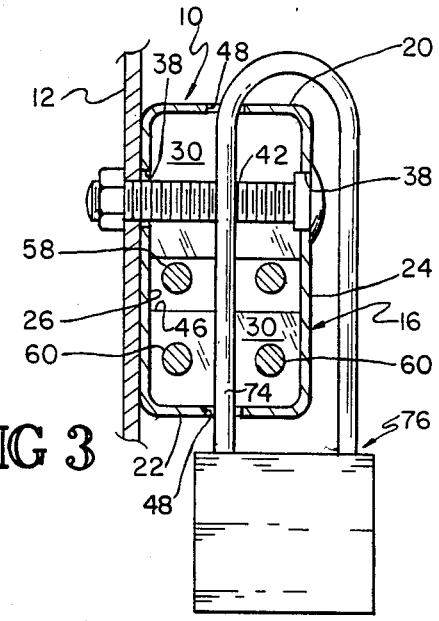
FIG. 3 is a transverse cross-sectional view of the device of FIG. 1 illustrating a second padlock in position to lock out the device.
Figure 1:
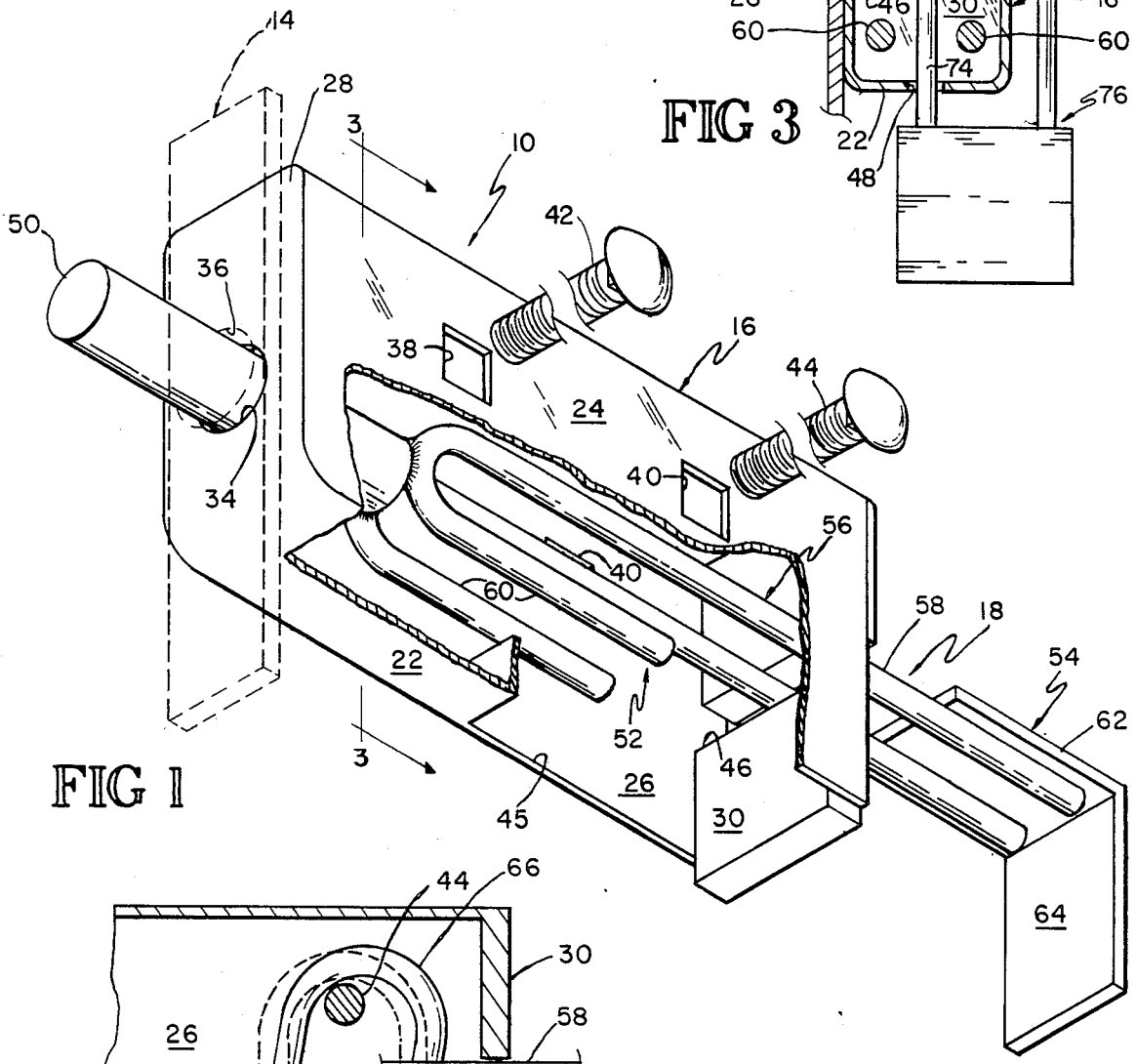
FIG. 1 is an isometric view of the locking device of this invention, certain parts being broken away for clarity of illustrations.
Figure 2:
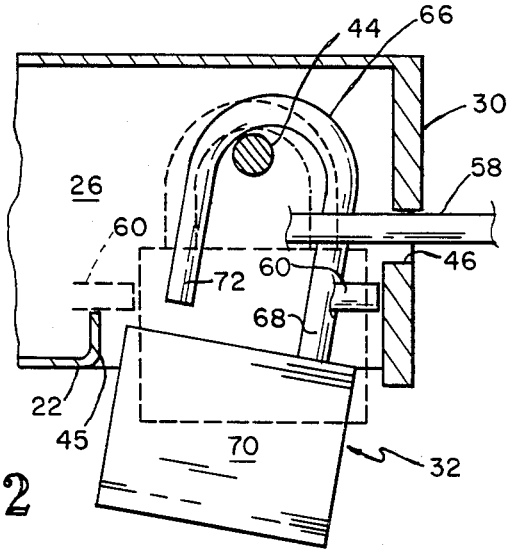
FIG. 2 is an enlarged view of the padlock receiving area of the locking device of FIG. 1.

Referring to FIGS. 1–3, a locking device 10 of this invention is mounted on a panel 12 of a closure door which is mounted for opening and closing movement relative to a frame 14. The locking device 10 comprises, as major components, a housing 16 and a bolt-handle mechanism 18.

The housing 16 is generally rectangular both in side elevation and in cross-section. The housing 16 includes a top wall 20, a bottom wall 22, a front wall 24, a back wall 26, and a pair of end walls 28, 30 which have been bent and welded into a unitary body of substantial strength having a cavity or chamber therein receiving the mechanism 18 along with all or part of a padlock 32.

A plurality of openings are provided in the housing 16 for a variety of functions. A first opening 34 in the end wall 28 allows passage of part of the bolt-handle mechanism 18 to pass therethrough into registry with an opening 36 in the frame 14 to provide for latching the closure panel 12 to the frame 14. First and second pairs of openings 38, 40 receive threaded fasteners 42, 44 for connecting the housing 16 to the door panel 12. An enlarged opening 45 in the bottom wall 22 provides access to the padlock 32 and allows the padlock 32 to move from its locked position shown in phantom lines in FIG. 3 downwardly to its unlocked position shown in solid lines therein. A slot-like opening 46 in the end wall 30 allows passage of part of the bolt-handle mechanism out of the housing 16. A further pair of aligned openings 48 are provided in the top and bottom walls 20, 22 for purposes more fully explained hereinafter.

The bolt-handle mechanism 18 comprises a bolt 50 which conveniently is of cylindrical configuration projecting through the opening 34 as shown in its latched position of FIG. 1 and is movable to a position substantially wholly enclosed within the housing 16 to allow opening movement of the door panel 12 relative to the frame 14. The bolt 50 is connected to a hook-like structure 52 having one end thereof extending through the slot 46 out of the housing 16. A handle 54 is connected to the end of the structure 52 and allows a user to advance and retract the bolt 50 merely by pushing or pulling on the handle 54.

The hook shaped structure 52 comprises a pair of hook shaped, parallel cylindrical rods 56 having a long leg 58 connected, at one end thereof, to the handle 54 and a short leg 60 which is parallel to the long leg 58 and disclosed therebeneath in a vertical plane parallel to the plane of movement of the mechanism 18.

The handle 54 may be of any suitable configuration and is illustrated as a generally L-shaped structure having a first arm 62 which is secured, as by welding or the like, to the ends of the long arms 58 and a second arm 64 perpendicular to the first arm 62.

Referring to FIG. 2, the padlock 32 comprises a shackle 66 having one end 68 entering into a body 70 of the padlock. The shackle 66 also includes a free end 72 which is received in the padlock body 70 in the locked position thereof and is spaced from the padlock body 70 in the unlocked position of the padlock 32. The padlock 32 is installed in the housing 16 at the time the housing 16 is bolted onto the door panel 12. This is accomplished by passing the carriage bolt 44 through the shackle 66 during attachment of the housing 16 to the door panel 12. It will accordingly be seen that the carriage bolt 44 comprises a support for the shackle 66 and consequently for the padlock 32. In the locked position of the lock 32, illustrated in phantom lines in FIG. 2, the padlock body 70 is advanced toward the carriage bolt 44 so that the padlock body 70 is elevated above the end of the short arm 60 of the structure 52. Consequently, in the locked position of the padlock 32, the short arm 60 is incapable of moving to the right in FIGS. 1 and 2 past the position shown. Consequently, the locking device 10 is incapable of unlocking or unlatching movement until the padlock 32 has been unlocked.

When the padlock 32 is unlocked, the padlock body 70 moves downwardly relative to the support 44 and relative to the end of the short arm 60. This allows the short arm 60 of the hook shaped structure 52 to pass over the top of the padlock body 70. Since short arms 60 are spaced apart, they pass on opposite sides the shackle 66.

One of the applications for the locking device 10 of this invention is on doors of mini warehouses. One of the desirable features of a locking device for a mini warehouse is a provision whereby the mini warehouse owner can lock out an unpaying tenant to prevent the tenant from gaining access to his goods. Referring to FIG. 3, the housing 16 of this invention provides the aligned openings 48 and the top and bottom walls 20, 22 for receiving a shackle leg 74 of a long shackle padlock 76. The padlock 76 is installed as shown in FIG. 3 with the shackle leg 74 passing between the rods 56 of the hook like structure 52 at a location between the end wall 28 and the carriage bolt 42. It will accordingly be seen that attempted movement of the bolt-handle mechanism 18 in an unlocking direction toward the right in FIG. 1 is prevented since the end of the bolt 50 comes into contact with the shackle leg 74. It is accordingly evident that the locking device 10 affords a lock out provision whereby the owner of a mini storage warehouse can lock out an unpaid tenant.

Figure 6:
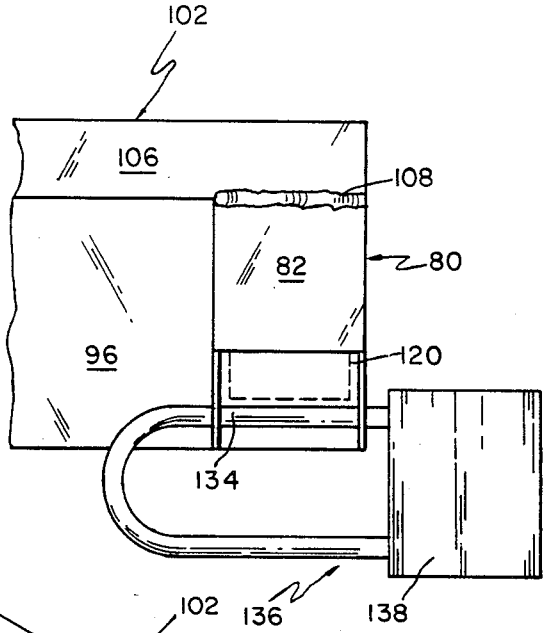
FIG. 6 is a partial front elevational view of the embodiment of FIGS. 4 and 5 illustrating a lock out technique.
Figure 4:
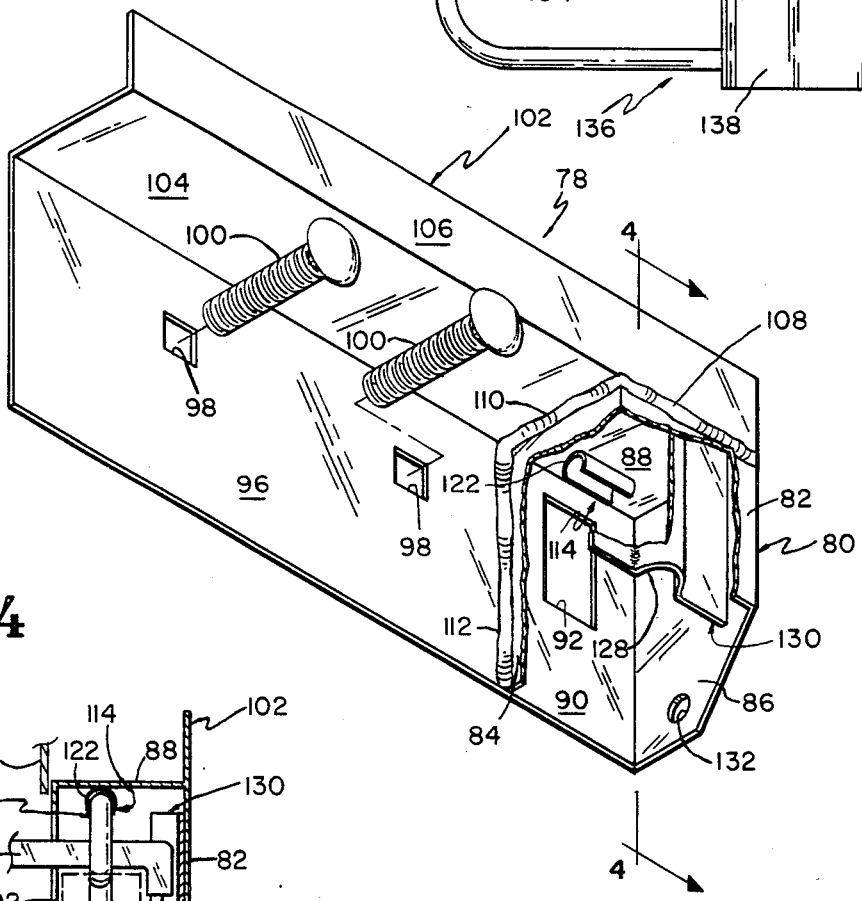
FIG. 4 is an isometric view of another embodiment of this invention, certain parts being broken away for clarity of illustration.
Figure 5:
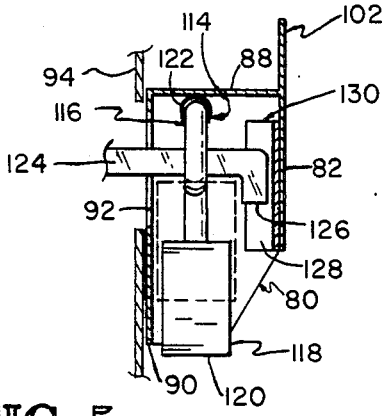
FIG. 5 is a cross-sectional view of the embodiment of FIG. 4 taken substantially along line 4—4 thereof as viewed in the direction indicated by the arrows.

Referring to FIGS. 4–6, there is illustrated a locking device 78 or protected assembly for a padlock comprising another embodiment of this invention. The locking device 78 comprises a generally rectangular enclosure or housing 80 including a front wall 82, a pair of side walls 84, 86 and a top wall 88. The back of the housing 80 is open, as by the provision of a back wall 90 having an opening 92 therein. In order to mount the locking device 78 on a door 94, a back wall 96 is provided. The back wall 96 comprises a planar extension of the back wall 90 and extends beyond the confines of the side walls 84, 86 and provides a pair of square openings 98 therein for receiving carriage bolts 100. Completing the frame of the locking device 78 is a handle 102 comprising a planar extension of the front wall 82. The handle 102 is preferably of substantial lateral extent, extending beyond the confines of the side walls 84, 86. To this end, a planar extension 104 of the top wall 88 extends generally perpendicular to the back wall 96 and to an elongate planar member 106 comprising the handle 102.

In order to fabricate the locking device 78, a piece of planar stock is bent at right angles, forming the junction between the back walls 90, 96 and the top walls 88, 104 with a second bend being made to form the planar section 106. The remainder of the enclosure 80, comprising the front wall 82 and the side walls 84, 86 are provided by bending a planar piece of stock and welding the stock to the frame along weldments 108, 110, 112.

Inside the housing 80 and secured to the top wall 88 thereof are means 114 for grasping and holding a shackle 116 of a padlock 118 in such a manner that the body 120 of the padlock 118 resides below the shackle 116. To this end, the grasping means 114 may comprise a generally C-shaped clip 122 in which the free ends thereof are spaced closer than the diameter of the shackle 116.

As shown best in FIG. 5, the closure with which the locking device 78 is associated includes a tongue or striker 124 having a down turned end 126 which is received, in the closed position of the closure, in a groove 128 of a guide member 130 positioned inside the housing 80, as by securing the same to the front wall 82.

Operation of the locking device 78 should now be apparent. With the locking device 78 secured to the door panel 90 by the carriage bolts 100, the door panel 94 is moved toward its closed position. The tongue 124 enters the opening 92 and passes between the shackle 116 and the padlock body 20 to a location in the groove 128 of the guide member 130. It will be seen that, with the padlock 118 in its unlocked position shown in solid lines in FIG. 5, there is adequate room for moving the down turned end 126 of the tongue 124 underneath the shackle 116. In order to lock the device 78, the padlock body 120 is merely moved upwardly into locking engagement with the shackle 116 as padlocks are conventionally locked. With the padlock body 120 in its locked position, illustrated in dashed lines in FIG. 5, it will be seen that the down turned end 126 of the tongue 124 is no longer capable of moving underneath the shackle 116. Thus, the end 126 constitutes a blocking means to prevent movement of the locking device 78 toward an open position when the padlock 118 is in its locked position.

As in the embodiment of FIGS. 1–3, one of the applications for the locking device 78 of this invention is on doors of mini warehouses. Accordingly, it is desirable to provide a lockout feature. Referring to FIG. 6, the housing 80 of this invention provides a pair of aligned openings 132 at a location in the path of movement of the padlock body 120 as it moves from a locked toward an unlocked position. Accordingly, a long shackle 134 of a padlock 136, such as a bicycle lock, may be placed in the openings 132 and locked to the padlock body 138. It will accordingly be seen that the long shackle 134 prevents opening movement of the padlock body 128 thereby preventing an unpaying tenant from gaining access to his goods.

Although the invention has been described in its preferred forms with a certain degree of particularity, it is understood that the present disclosure is only by way of example and that numerous changes in the details of construction and in the combination and arrangement of parts may be resorted to without departing from the spirit and scope of the invention as hereinafter claimed.

I claim:

1. A locking device comprising a housing having a plurality of openings therein;

a mechanism mounted for movement in the housing having a bolt at one end of the mechanism extending out of the housing through one of the openings, a handle at a second end of the mechanism extending out of the housing through another of the openings for advancing and retracting the bolt, and a structure interconnecting the first and second ends for selectively blocking and unblocking movement of the bolt in response to a padlock body being appropriately located in the housing, the mechanism being mounted for movement in a plane and two of the housing openings being aligned on an axis perpendicular to the plane;

a support in the housing comprising a fastener extending through the openings perpendicular to the plane for securing the housing to a support; and a padlock having a shackle supportably received on the fastener and a body at least partially in the housing located in blocking relation with the structure in a locked position of the padlock and movable to an unblocking position allowing movement of the structure in response to unlocking movement of the padlock, the padlock body being accessible through one of the housing openings.

2. The locking device of claim 1 wherein the structure includes a first element rigidly interconnecting the bolt and handle and extending therebetween in a position avoiding contact with the padlock in all positions thereof and a second element extending toward the padlock body for engaging the padlock body in a locked position of the padlock, the padlock body being movable, during unlocking movement, to a position out of contact with the second element.

3. The locking device of claim 2 wherein the first and second elements define a generally hook-shaped structure connected at the bight thereof to the bolt.

4. The locking mechanism of claim 1 wherein a second pair of the housing openings are aligned generally parallel to the plane for passing a shackle of a second padlock through the housing, the shackle of the second padlock providing means for preventing unlocking movement of the bolt.

5. A protective assembly for a padlock of the type having a body and a shackle shiftable into and out of locking engagement with the body, comprising a padlock enclosure having front, side and top walls providing an open bottom end defining a first path for receiving the padlock and an open back defining a second path intersecting the first path;

means in the enclosure for supportably receiving the shackle of the padlock and supporting the padlock in a vertical position with the shackle elevated above the body, the supportably receiving means comprises a C-shaped clip fixed, at the bight thereof, to the top wall for grasping and holding the shackle; and a tongue configured to pass through the open back along a second path through the shackle when the padlock is supported by the C-shaped clip and the shackle is out of locking engagement with the body, the tongue having blocking structure engagable with the body when the shackle is closed about the tongue is locking engagement with the body for preventing withdrawal of the tongue.

6. The assembly of claim 5 wherein the assembly comprises a wall, generally perpendicular to the side wall, extending beyond the confines of the side wall, the back wall providing means for securing the assembly to a closure member.

7. The assembly of claim 6 wherein the receiving means comprise square openings having carriage bolts therein.

8. The assembly of claim 6 further comprising a handle carried by the enclosure and back wall.

9. The assembly of claim 8 wherein the assembly comprises a wall extension, extending parallel to the enclosure top wall joined to the back wall, the handle comprising a planar of the enclosure front wall, the planar extension being connected to the top wall extension.

* * * * *